US005544769A

United States Patent [19]

Dowler et al.

[11] Patent Number: 5,544,769

[45] Date of Patent: Aug. 13, 1996

[54] PACKAGE TO BE MOUNTED ON A BOTTLE

[75] Inventors: Glyn W. Dowler, Little Hadham; Edward I. Pruchniewicz, West Yorks, both of United Kingdom

[73] Assignee: Mailway (UK) Limited, West Yorkshire, England

[21] Appl. No.: 298,054

[22] Filed: Aug. 30, 1994

[30] Foreign Application Priority Data

May 13, 1994 [GB] United Kingdom ..... 9409579

[51] Int. Cl.[6] ..... B65D 23/12

[52] U.S. Cl. ..... 215/227; 215/390; 215/DIG. 7

[58] Field of Search ..... 215/227, 228, 215/232, DIG. 7, 100 R, 386, 390; 220/212, 214, 359, 694, 737; 229/90

[56] References Cited

U.S. PATENT DOCUMENTS

| | | | |
|---|---|---|---|
| 183,322 | 10/1876 | Newman | 215/DIG 7 X |
| 1,867,561 | 7/1932 | Bobrick | 229/90 |
| 2,135,236 | 11/1938 | Koppelman | 229/90 |
| 2,318,434 | 5/1943 | Strauch | 215/386 X |
| 2,458,737 | 1/1949 | Salkowitz | 229/90 |
| 3,017,047 | 1/1962 | Payson et al. | 215/DIG. 7 |
| 4,039,097 | 8/1977 | Venti | 215/386 X |
| 4,150,761 | 4/1979 | Collins | 215/DIG. 7 |
| 4,632,273 | 12/1986 | Rhine | 215/DIG. 7 |
| 5,184,390 | 2/1993 | Weder | 215/386 X |

FOREIGN PATENT DOCUMENTS

| | | | |
|---|---|---|---|
| 679238 | 9/1952 | United Kingdom | 94/125 |
| 1191291 | 5/1970 | United Kingdom | 215/DIG.7 |

*Primary Examiner*—Allan N. Shoap
*Assistant Examiner*—Nathan Newhouse
*Attorney, Agent, or Firm*—Richard E. Jenkins P.A.

[57] ABSTRACT

A package is formed by locating a vacuum formed plastics insert into a glass with inward movement of the plastics insert into the glass being restricted by an edge of the insert abutting the rim of the glass. The insert is a friction of force fit on the inner portion of the glass adjacent to the rim. A plastic sleeve is then shrink wrapped around the exterior surface of the glass and over the rim of the glass to hold the insert in place in the glass. The top of the insert includes an opening which is pushed over the enlarged cap of a bottle to retain the package on the bottle.

13 Claims, 2 Drawing Sheets

PACKAGE TO BE MOUNTED ON A BOTTLE

The present invention relates to a package adapted to be mounted on a support, a package when mounted on a support and a method of assembling and mounting a package on a support. The invention is particularly, although not exclusively applicable to mounting a glass on the neck of a bottle.

BACKGROUND ART

It has previously been proposed to mount a glass on top of a bottle of whisky. One of the problems associated with mounting glasses on these bottles is that, once the bottle has been filled with whisky it is not allowed to leave the bonded premises and of course the bottle must first be filled and have the cap put on before the glass can be mounted.

It has been proposed to place a polystyrene disc around the neck of the bottle, and then to mount the glass over the neck of the bottle with the side wall of the glass being held away from contact with the neck by the polystyrene. A sleeve of plastics is then placed over the glass and part of the length of the bottle with the plastics then being shrunk around the glass and bottle to hold the parts in their relative positions. The shrinking of the plastics is a specialist process that the bottling factory have neither the equipment nor the expertise for. Furthermore, the disc is unsightly and the shrunk sleeve can tend to slip off.

Another proposal is to form plastics into a cone shape by vacuum moulding with the top of the cone being open. The bottom wall of the cone has an upwardly extending rim into which an upside down rim of a glass is wedged such that the cone extends up into the glass. The glass is then pushed down over the top of a bottle to cause the opening in the plastics cone to pass around and engage with the underside of the cap of the bottle. Unfortunately the wedging action of the glass must be sufficiently strong to prevent the glass from coming off accidentally and this makes the removal of the glass from the plastics difficult and dangerous as the glass may break because of the significant force which has to be used. Furthermore, the outside of the glass is exposed leaving it vulnerable to scratching or knocks.

It is an object of the present invention to attempt to overcome at least some of the above described disadvantages.

THE PRESENT INVENTION

According to one aspect of the present invention a package that is adapted to be mounted on a support comprises a first part that cooperates with an article to restrict movement of the first part and the article in at least one relative direction and a second part arranged to cooperate with the first part and the article to prevent separation of the first and second parts, the first part being adapted to be mounted on a support.

The first part may be adapted to be mounted on a support by being a push-fit or a snap-fit, for instance.

The article may be arranged to be spaced from a support when the package is mounted on a support.

The first part may be arranged to be a friction fit with the article and may be arranged to be a friction fit within the article.

The first part may extend into the article.

The second part may extend around and over surfaces of both the article and the first part.

The first part may comprise an insert.

The second part may comprise a sleeve.

The present invention also includes a package as herein referred to when mounted on a support.

According to a further aspect of the present invention a method of assembling a package comprises locating a first part relative to an article so that the article and the first part cooperate with each other to restrict relative movement in at least one relative direction and then locating a second part to prevent separation of the first and second parts with the first part being adapted to be mounted on a support.

The method may further include subsequently mounting the first part on a support.

The second part may comprise a sleeve which is shrunk in order to prevent separation of the first and second parts.

The support may comprise a bottle. The support may comprise the neck of the bottle or the cap of the bottle.

The article may comprise a glass.

The first part may be a plastics part and may, for instance, be vacuum formed.

The second part may comprise plastics and may comprise shrink wrapped plastics.

The present invention includes any combination of the herein referred to features or limitations.

DETAILED DESCRIPTION OF EMBODIMENT

Figure 1:
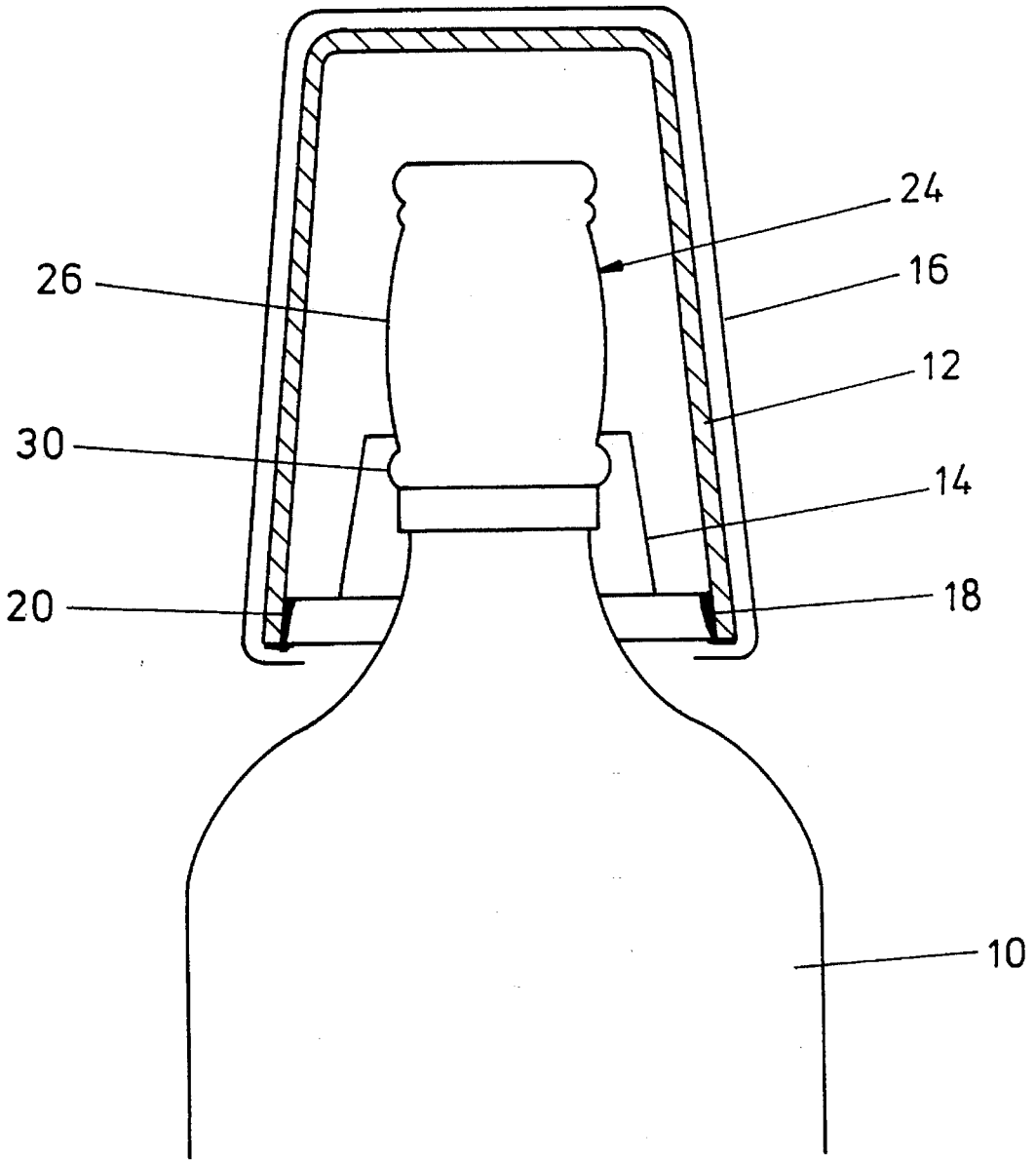
Figure 2:
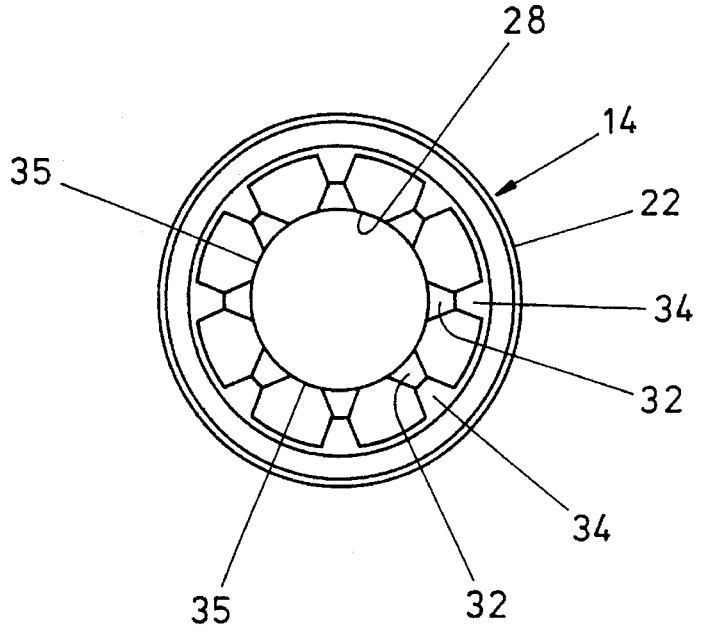
Figure 3:
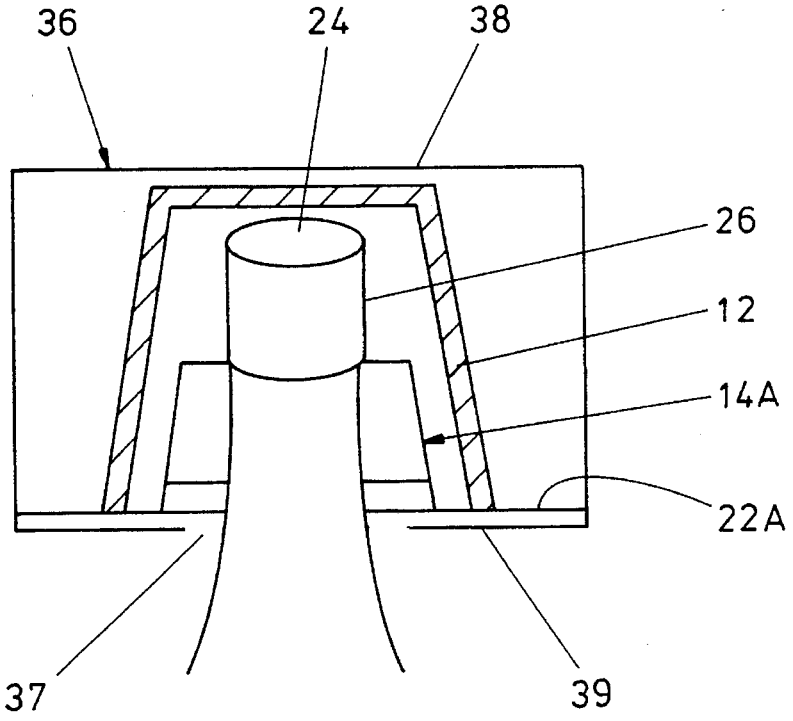

The invention may be carried into practice in various ways but two embodiments will now be described, by way of example only, and with reference to the accompanying drawings, in which:

FIG. 1 is a schematic cross-section through the top of a bottle 10 having a glass 12 mounted thereon; and FIG. 2 is a schematic plan view of a glass insert and FIG. 3 is a schematic cross-section similar to FIG. 1 of an alternative embodiment to retain the glass 12.

Before the glass 12 is mounted on the bottle 10, the insert 14 is first connected to the glass 12 and held thereon by the sleeve 16.

In order to connect the insert 14 to the glass 12, the insert 14 is supported on a flat surface and the glass 12 is then inverted to the position shown and pushed downwardly on to the insert. The downwardly facing rim of the glass first encounters an upwardly and inwardly extending annular edge 18 of the insert that has the effect of centralising the insert on the glass. Upon further downward movement of the glass, the inner surface of the glass adjacent to the rim passes over a generally upwardly extending surface 20 of the insert. The diameter of the surface 20 is substantially the same as the diameter of the glass adjacent to the rim and accordingly the insert is held in position relative to the glass by a friction or force fit. The lower rim of the glass rests on an outwardly extending lip 22 of the insert.

The insert 14 is then supported from beneath and at a region in from its circumference in order to raise the lip 22 and the rim of the glass off a supporting surface. The sleeve 16 is then passed over the glass with the sleeve being slightly longer than the length of the glass. Heat is then applied to the sleeve 16 to cause it to shrink onto the glass and to cause the lower end of the sleeve 16 to tuck under the lip 22 of the insert to hold the insert 14 firmly onto the glass 12. The package of the insert 14, the glass 12 and the sleeve 16 is assembled at a specialist factory remote from a whisky bottling plant. The package can then be supplied to the plant for attachment to the bottle, as described below.

When the bottle 10 has been filled the cap 24 is screwed onto the neck of the bottle. The cap 24 has a bulbous portion 26. The inverted glass and the insert 14 are then passed over the cap 24 and pushed downwardly in order to cause an opening 28 at the top of the insert to come into engagement with the uppermost part of the bulbous portion 26. Further downwards movement of the glass then causes the opening 28 to be flexed outwardly, or outwardly and upwardly with respect to the remainder of the insert, to snap the insert into position at the lower region of the bulbous portion 26, as shown in FIG. 1. Further upwards movement of the insert is prevented or inhibited by the bulbous portion and further downwards movement of the insert relative to the cap is prevented or inhibited by abutment of the walls of the opening with a flange 30 of the cap located immediately beneath the bulbous portion.

The sleeve 16 can be printed with advertising or other information, if desired. The sleeve 16 may be formed with a weakened line, which may for instance be formed by a series of perforations. Thus the sleeve 16 can easily be ripped off by a user, either before or after the glass has been removed from the top of the bottle. The glass is removed from the top by pulling the glass upwardly to cause the opening 28 of the insert to pass again over the bulbous portion 26 of the cap 24.

The insert 14 is vacuum formed and can be of any shape required in order to hold a particular shaped glass onto a particular neck of a bottle. The glass need not necessarily be circular in cross-section and may indeed have a number of substantially planar walls.

The insert is shown in slightly more detail in FIG. 2. Adjacent to the opening 28 a number of flat generally horizontal walls 32 extend. A downwardly and slightly outwardly extending wall 34 extends from the circumferentially outer portion of the walls 32. A generally vertical wall 35 extends down from the space between the generally horizontal walls 34 from the opening 28 at the circumferentially inner portion of the walls 34. The insert so formed is strong in the directions that the most stress is taken and yet flexible enough to be quickly and conveniently mounted on the glass and then on the cap.

The embodiment shown in FIG. 3 shows an insert 14A similar to the insert 14 mounted over the bulbous portion 26 of the cap 24. The insert 14A differs in that it is not shown as being a friction or force fit within the glass although, if desired, the insert could be so fitted. The insert 14A also differs from the insert 14 in that the outwardly extending lip 22A is of greater extent than the lip 22 such that the lip 22A extends beneath the lower rim of the glass well beyond the periphery of that rim.

The insert is retained in place relative to the glass 12 by a cardboard carton 36. The carton, which may be circular or square in plan view includes an opening 37 and a closable hinged top 38. The glass and insert are moved down through the carton when the top 38 is open to the position shown. Then the top 38 is closed and it is taped or glue into the position shown. The lower wall 39 of the carton and the top 38 may abut the lip 22A and the top of the glass to hold the carton fast on the glass and insert, if desired.

Attaching the insert 14A to a bottle top is the same as for the attachment of the insert 14.

It will be appreciated that the insert 14 could be arranged to be connected to the glass of the bottle itself and the insert 14 can be adapted for attachment to other types of cap 24 or bottle 10. Alternatively the insert could be attached to other articles or the package could contain articles other than glass.

What we claim is:

1. A package for placement on a bottle having a neck, said package before placement on said bottle comprising an article, a first and a second part, said first part inserted within and being concentrically engaged with said article, said first part defining an opening therethrough for mounting said first part on the bottle whereby said first part supports said package on the bottle, said article having opposed ends, said first part having means at said opening for engaging the neck of the bottle, a portion of said means being spaced axially and radially from said ends, said first part being radially and axially smaller than said article, said second part engaging with said first part and said article to prevent separation of said first and second parts.

2. A package according to claim 1 in which said opening of said first part is structured so as to push fit on a bottle.

3. A package according to claim 1 in which said first part is structured so as to snap fit on a bottle.

4. A package according to claim 1 in which said article is arranged to be spaced from the bottle when said package is mounted on the bottle.

5. A package according to claim 1 in which said first part is arranged to be a friction fit with said article.

6. A package according to claim 5 in which said first part is arranged to be a friction fit within said article.

7. A package according to claim 1 in which said first part extends into said article.

8. A package according to claim 1 in which said first part comprises an insert.

9. A package according to claim 1 in which said second part comprises a sleeve.

10. A package according to claim 1 in which said second part comprises a carton.

11. A package according to claim 10 in which said carton includes a portion that is arranged to be closed, after said first part and said article have been moved into a desired position in order to prevent separation of said first and second parts.

12. A package according to claim 1 when mounted on the bottle.

13. A package according to claim 1 in which said article comprises a glass.

* * * * *